US009401553B2

(12) United States Patent
Hamada

(10) Patent No.: US 9,401,553 B2
(45) Date of Patent: Jul. 26, 2016

(54) CONNECTOR DEVICE

(71) Applicant: Yazaki Corporation, Minato-ku, Tokyo (JP)

(72) Inventor: Keiji Hamada, Utsunomiya (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/824,674

(22) Filed: Aug. 12, 2015

(65) Prior Publication Data

US 2015/0349443 A1 Dec. 3, 2015

Related U.S. Application Data

(63) Continuation of application No. PCT/JP2014/053359, filed on Feb. 13, 2014.

(30) Foreign Application Priority Data

Feb. 13, 2013 (JP) ..... 2013-025744

(51) Int. Cl.
*H01R 13/658* (2011.01)
*H01R 12/70* (2011.01)
(Continued)

(52) U.S. Cl.
CPC ..... *H01R 12/7076* (2013.01); *H01R 12/596* (2013.01); *H01R 13/502* (2013.01); *H01R 13/6582* (2013.01); *H01R 13/6592* (2013.01); *H01R 12/675* (2013.01); *H01R 12/79* (2013.01); *H01R 13/5812* (2013.01)

(58) Field of Classification Search
CPC .. H01R 4/2433; H01R 4/2429; H01R 13/506; H01R 13/658; H01R 13/65807; H01R 23/662
USPC ..... 439/497, 404, 405, 579
See application file for complete search history.

(56) References Cited

U.S. PATENT DOCUMENTS 6,171,134 B1 * 1/2001 Lai ..... H01R 12/675 439/405
6,500,013 B1 * 12/2002 Wang ..... H01R 12/598 439/108

(Continued)

FOREIGN PATENT DOCUMENTS

CN 2770119 Y 4/2006
JP H05-328573 A 12/1993

(Continued)

OTHER PUBLICATIONS

May 13, 2014—International Search Report—Intl App PCT/JP2014/053359.

(Continued)

*Primary Examiner* — Hien Vu
(74) *Attorney, Agent, or Firm* — Banner & Witcoff, Ltd.

(57) ABSTRACT

A connector device includes an electric wire side connector to which a shielded electric wire is connected, and a board side connector that is connected to a circuit board. The electric wire side connector is engaged with the board side connector. The electric wire side connector includes an electric wire side housing and an electric wire clamping member. The board side connector includes a board side housing and a fixing metal fitting. A bus bar plate electrically contacts the fixing metal fittings when the board side connector is engaged with the electric wire side connector.

4 Claims, 12 Drawing Sheets

(51) Int. Cl.

| | |
|---|---|
| ***H01R 13/6592*** | (2011.01) |
| ***H01R 13/502*** | (2006.01) |
| ***H01R 13/6582*** | (2011.01) |
| ***H01R 12/59*** | (2011.01) |
| *H01R 12/67* | (2011.01) |
| *H01R 12/79* | (2011.01) |
| *H01R 13/58* | (2006.01) |

(56) References Cited

U.S. PATENT DOCUMENTS 7,430,801 B2 * 10/2008 Iida ..... H01R 43/16 29/883
7,815,467 B2 * 10/2010 Tsuchida ..... H01R 12/716 439/579
2008/0242149 A1 10/2008 Konno et al.

FOREIGN PATENT DOCUMENTS

JP 3118719 U 2/2006
JP 2008-251248 A 10/2008
JP 2009-048941 A 3/2009

OTHER PUBLICATIONS

Aug. 18, 2015—(WO) Intl Preliminary Report on Patentability—App PCT/JP2014/053359.

* cited by examiner

CONNECTOR DEVICE

CROSS REFERENCE TO RELATED APPLICATIONS

This application is a continuation of PCT application No. PCT/JP2014/053359, which was filed on Feb. 13, 2014 based on Japanese Patent Application (No. 2013-025744) filed on Feb. 13, 2013, the contents of which are incorporated herein by reference.

BACKGROUND OF THE INVENTION

1. Field of the Invention

The present invention relates to a connector device.

2. Related Art

Traditionally, a connector device is known (refer to JP-A-2008-251248) which includes an electric wire side connector that is connected to a shielded electric wire, and a board side connector. When the electric wire side connector is engaged with the board side connector, a cable side grounding wire and a board side grounding circuit are connected electrically.

A receptacle 503 in a connector device 501 shown in FIG. 12 has a receptacle side first USB terminal portion 513, which is connected with a plug side first USB terminal portion 511, and a receptacle side second terminal portion 517, which is connected with a plug side second terminal portion 515 of a plug 509, which are displaced in a direction perpendicular to an insertion direction in which the plug 509 is inserted into and engaged with a receptacle housing 507 in a receptacle side shielding case 505, and the insertion direction. The plug 509 has the plug side first USB terminal portion 511 and the plug side second terminal portion 515 which are displaced in a direction perpendicular to the insertion direction and displaced in the insertion direction, in a plug side shielding case 519 which is embedded in the receptacle side shielding case 505, at positions corresponding to the receptacle side first USB terminal portion 513 and the plug side second terminal portion 515 of the receptacle 503.

When the plug 509 is inserted into the receptacle 503, the plug side first USB terminal portion 511 is connected to the receptacle side first USB terminal portion 513 of the receptacle 503, and subsequently the plug side second terminal portion 515 is connected to the receptacle side second terminal portion 517 of the receptacle 503. At the same time, the receptacle side shielding case 505 is electrically connected with the plug side shielding case 519.

However, in the above connector device 501, the cable side grounding wire and the board side grounding circuit are electrically connected by engaging the plug side shielding case 519 with the receptacle side shielding case 505. The receptacle side shielding case 505 is connected to the board side grounding circuit of a board not shown through a conductive piece 521. In this way, because the receptacle side shielding case 505 and the plug side shielding case 519, which are made of metal for shielding, are added to cover the insulative receptacle housing 507 and plug housing 523, respectively, there are the following problems. The connector device 501 is upsized, a lot of metal members are used and the cost is increased.

The present invention is made in view of the above situation, and the object of the present invention is to provide a connector device, whose size can be reduced and whose cost can be reduced because the metal members for shielding are reduced.

SUMMARY OF THE INVENTION

The above object of the present invention is accomplished by the following constitutions.

(1) A connector device includes an electric wire side connector to which a shielded electric wire is connected and a board side connector that is connected to a circuit board. The electric wire side connector is engaged with the board side connector. The electric wire side connector includes an electric wire side housing which receives and holds electric wire side terminals which are electrically connected to conductors of the shielded electric wire, and an electric wire clamping member which clamps a shielding portion which is exposed at a distal end of the shielded electric wire between the electric wire clamping member and a bus bar plate which is fixed to the electric wire side housing. The board side connector includes a board side housing which receives and holds board side terminals which are electrically connected to the electric wire side terminals, respectively, and a fixing metal fitting which is fixed to the board side housing and is electrically connected to a grounding circuit of the circuit board while holding and fixing the board side housing to the circuit board. The bus bar plate electrically contacts the fixing metal fittings when the board side connector is engaged with the electric wire side connector.

According to the connector device of the constitution of the above (1), the shielding portion, which is exposed at the distal end of the shielded electric wire, becomes electrically connected to the bus bar plate by being clamped between the bus bar plate and the electric wire clamping member which are fixed to the electric wire side housing in the electric wire side connector. Then, when the electric wire side connector is engaged with the board side connector which is held and fixed to the circuit board, the bus bar plate which is fixed to the electric wire side housing electrically contact the fixing metal fittings which are fixed to the board side housing of the board side connector. Because the fixing metal fittings are electrically connected to the grounding circuit of the circuit board, the shielding portion of the shielded electric wire and the grounding circuit at the circuit board side can be electrically connected. Thus, the metal shielding cases for sealing, which cover the electric wire side housing and the board side housing, respectively, can be omitted.

(2) In the connector device according to (1), the electric wire side connector has an electric wire sheath cover which clamps a part of the shielded electric wire that is covered with a sheath portion with a back end portion of the electric wire clamping member which clamps the shielding portion.

According to the connector device of the constitution of the above (2), because the part of the shielded electric wire that is covered with the sheath portion at the back side of the distal end to which the electric wire side terminals are connected, is clamped by the back end portion of the electric wire clamping member and the electric wire sheath cover, it is not feared that the tensile force that acts on the shielded electric wire would act on the conductor contact portion where the conductors of the shielded electric wire and the electric wire side terminals contact. Thus, it is possible to improve the connection reliability of the electric wire side connector which is connected to the end of the shielded electric wire.

(3) In the connector device according to (1) or (2), the bus bar plate is elastically deformable along a contact direction in which the bus bar plate contact the fixing metal fitting.

According to the connector device of the constitution of the above (3), by making the bus bar plate contact the fixed metal fittings while being elastically deformable along the contact direction, a high electrical contact reliability is obtained.

The present invention has been briefly described above. Details of the invention will become more apparent after embodiments of the invention described below (hereinafter referred to as "embodiments") are read with reference to the accompanying figures.

DETAILED DESCRIPTION OF THE EXEMPLARY EMBODIMENTS

Below, an embodiment of the invention is described with reference to the figures.

Figure 1:
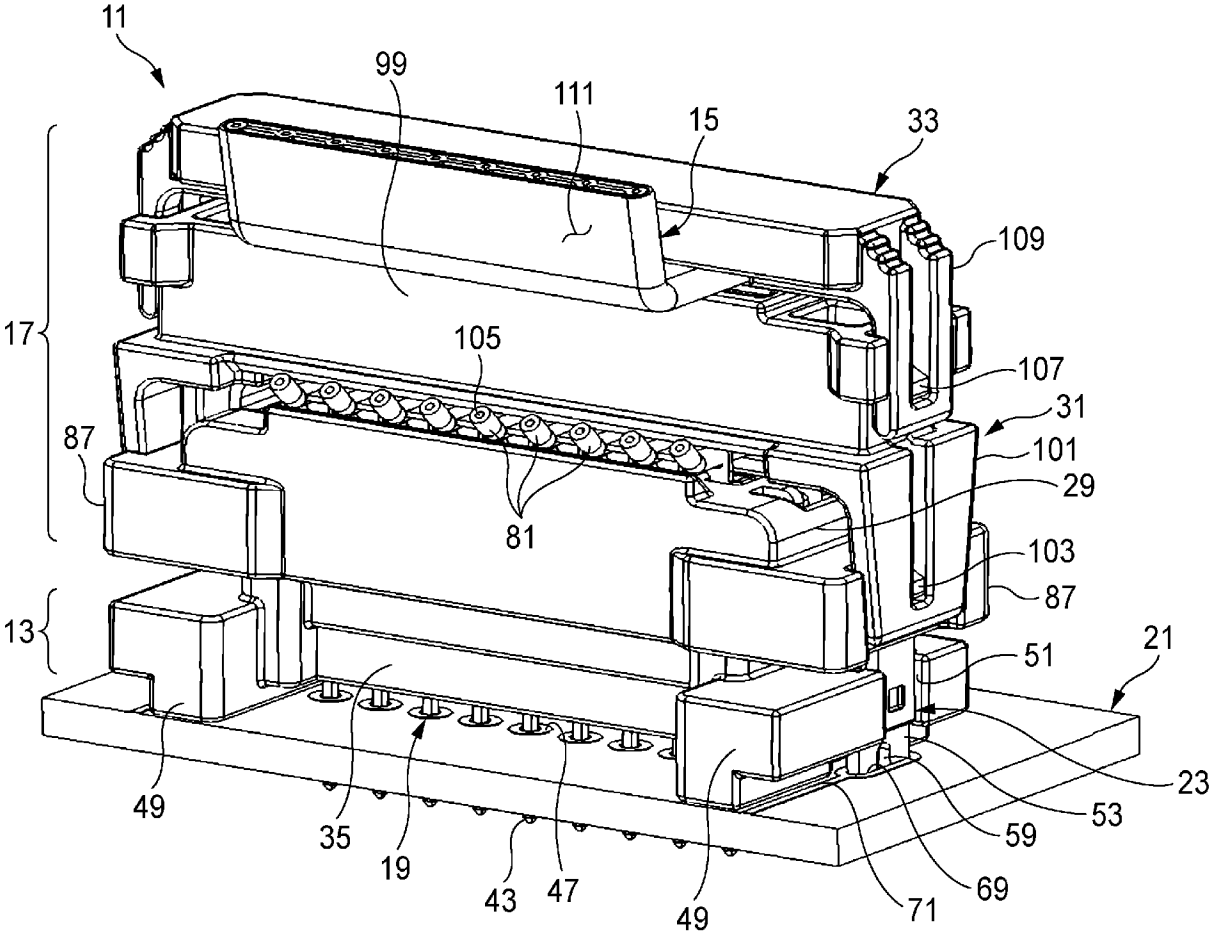
FIG. 1 is a perspective view which indicates a connector device according to one embodiment of the present invention with a circuit board and a shielded electric wire.

As shown in FIG. 1, a connector device 11 according to the present embodiment mainly includes a board side connector 13, which is mounted to a circuit board 21 contained in a device such as an ECU (Electronic Control Unit), and an electric wire side connector 17, which is fixed to a shielded electric wire 15 and engaged with the board side connector 13.

Figure 2:
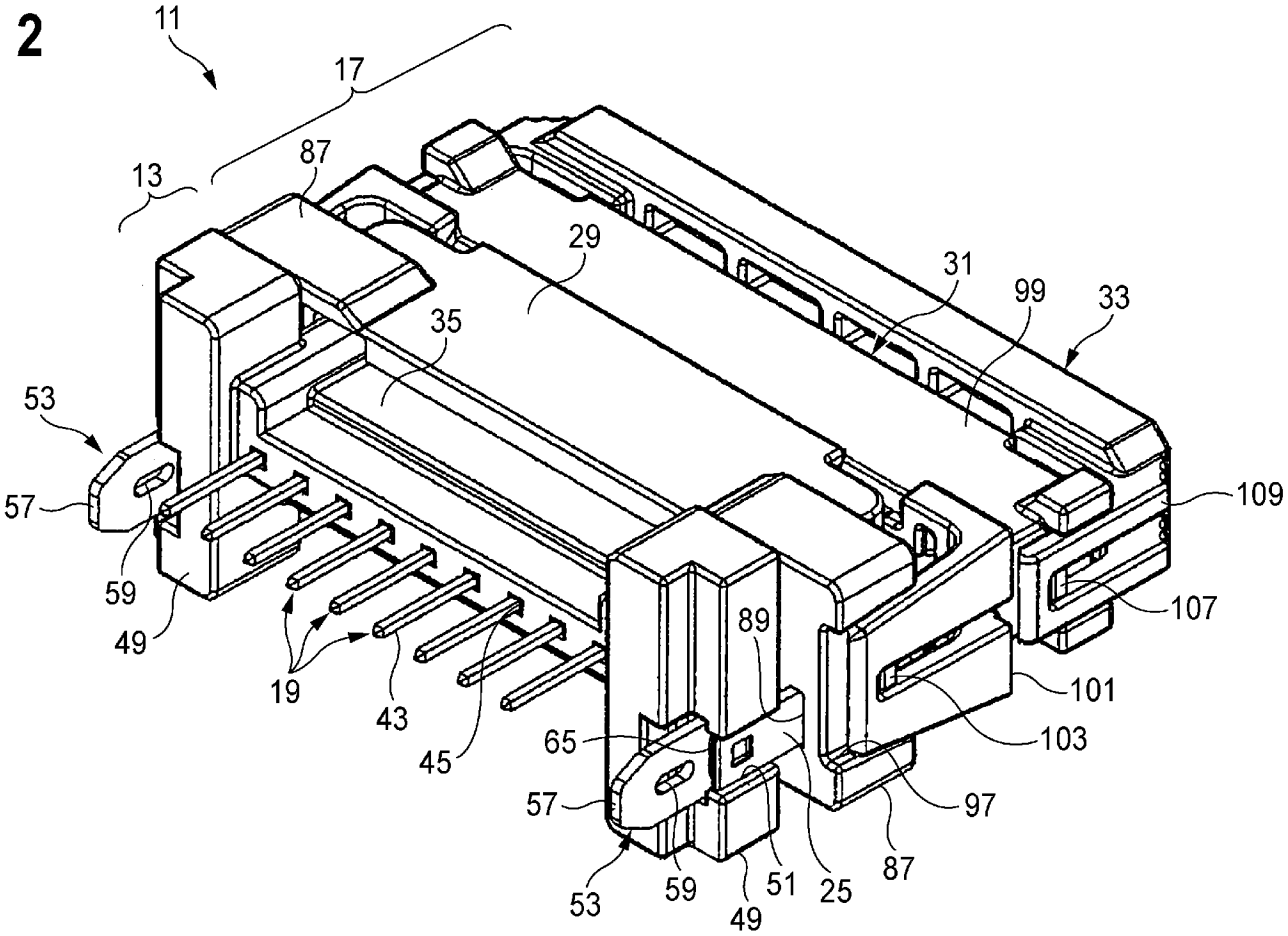
FIG. 2 is a perspective view of the connector device shown in FIG. 1.

As shown in FIG. 2, a plurality of board side terminals 19 are derived from the board side connector 13, and soldered to conductors of the circuit board 21. A plurality of members are assembled in the engaging direction to integrally form the electric wire side connector 17 which is engaged to the board side connector 13.

Figure 3:
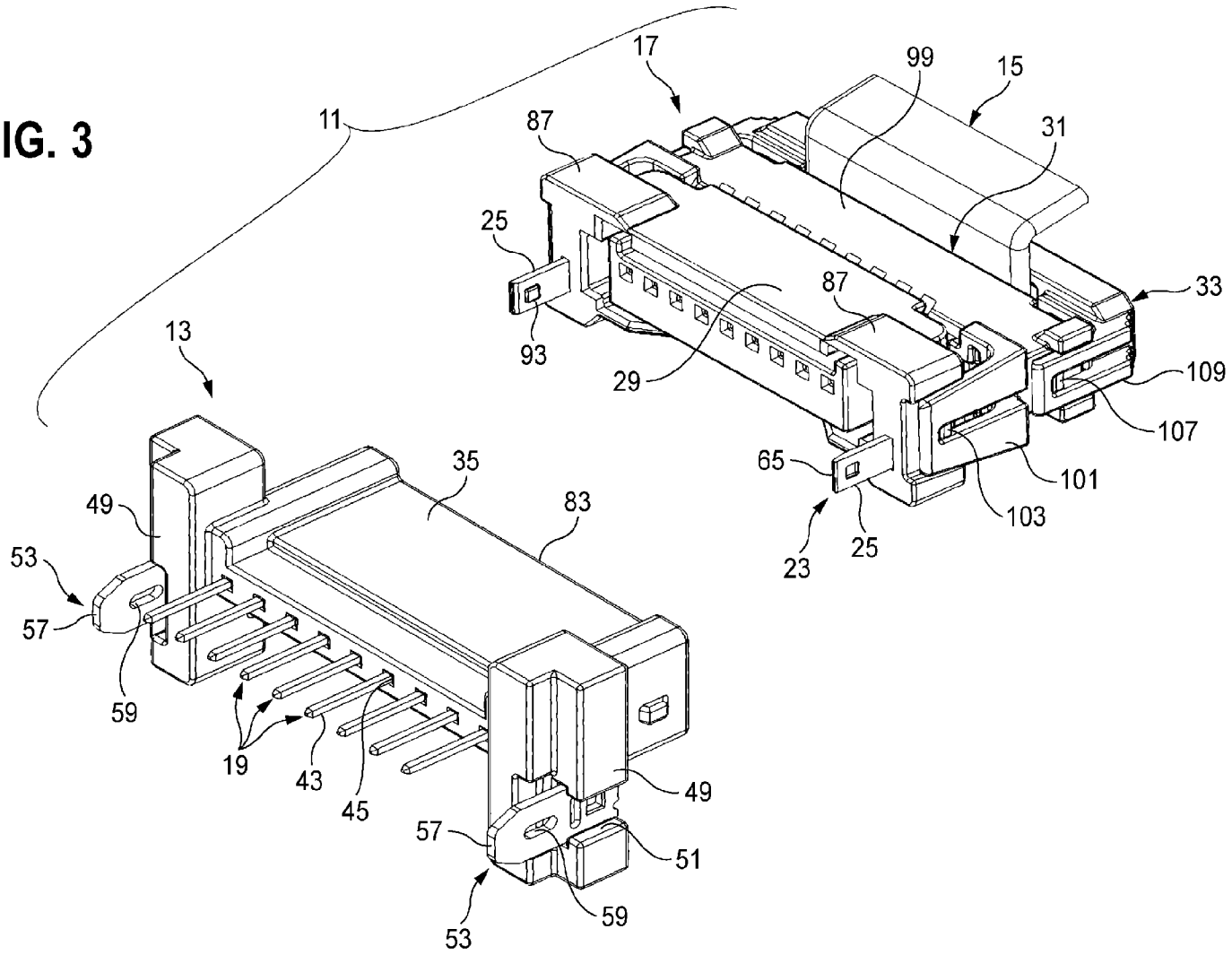
FIG. 3 is a perspective view in which a board side connector and an electric wire side connector shown in FIG. 2 are isolated from each other.

As shown in FIG. 3, the electric wire side connector 17 which is separated from the board side connector 13, has a bus bar plate 23, parts of which (U-shaped two ends projecting pieces 25 to be described) project from both sides toward the front side of the engaging direction of the electric wire side connector 17. The bus bar plate 23, as to be described below, is electrically connected to a shielding portion 27 (refer to FIG. 8) of the shielded electric wire 15 to which the electric wire side connector 17 is attached. In the present specification, the engaging side where the board side connector 13 and the electric wire side connector 17 are engaged with each other is referred to as the "front" side.

Figure 4:
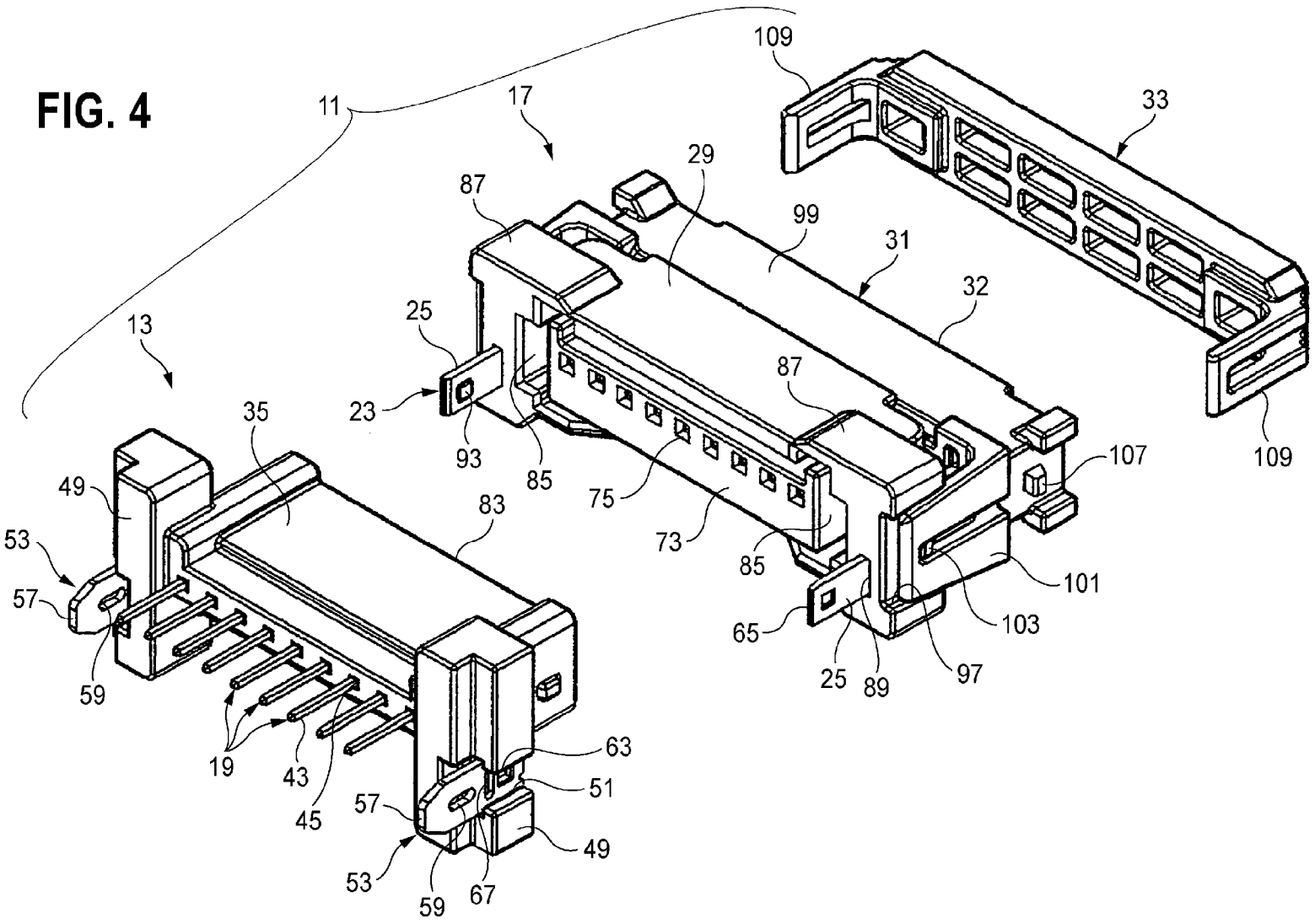
FIG. 4 is an exploded perspective view which indicates the electric wire side connector, from which an electric wire sheath cover shown in FIG. 3 is separated, and the board side connector.

As shown in FIG. 4, the electric wire side connector 17 has an electric wire side housing 29 made of synthetic resin. The electric wire side connector 17 has a strain relief 31 which is an electric wire clamping member which is mounted to the electric wire side housing 29. The electric wire side connector 17 further has an electric wire sheath cover 33 which is mounted from the back side to a back end portion 32 of the strain relief 31. That is, the electric wire side connector 17 has the electric wire side housing 29, the bus bar plate 23, the strain relief 31 and the electric wire sheath cover 33, which are laminated and assembled from the bottom side to the top side shown in FIG. 1.

Figure 5:
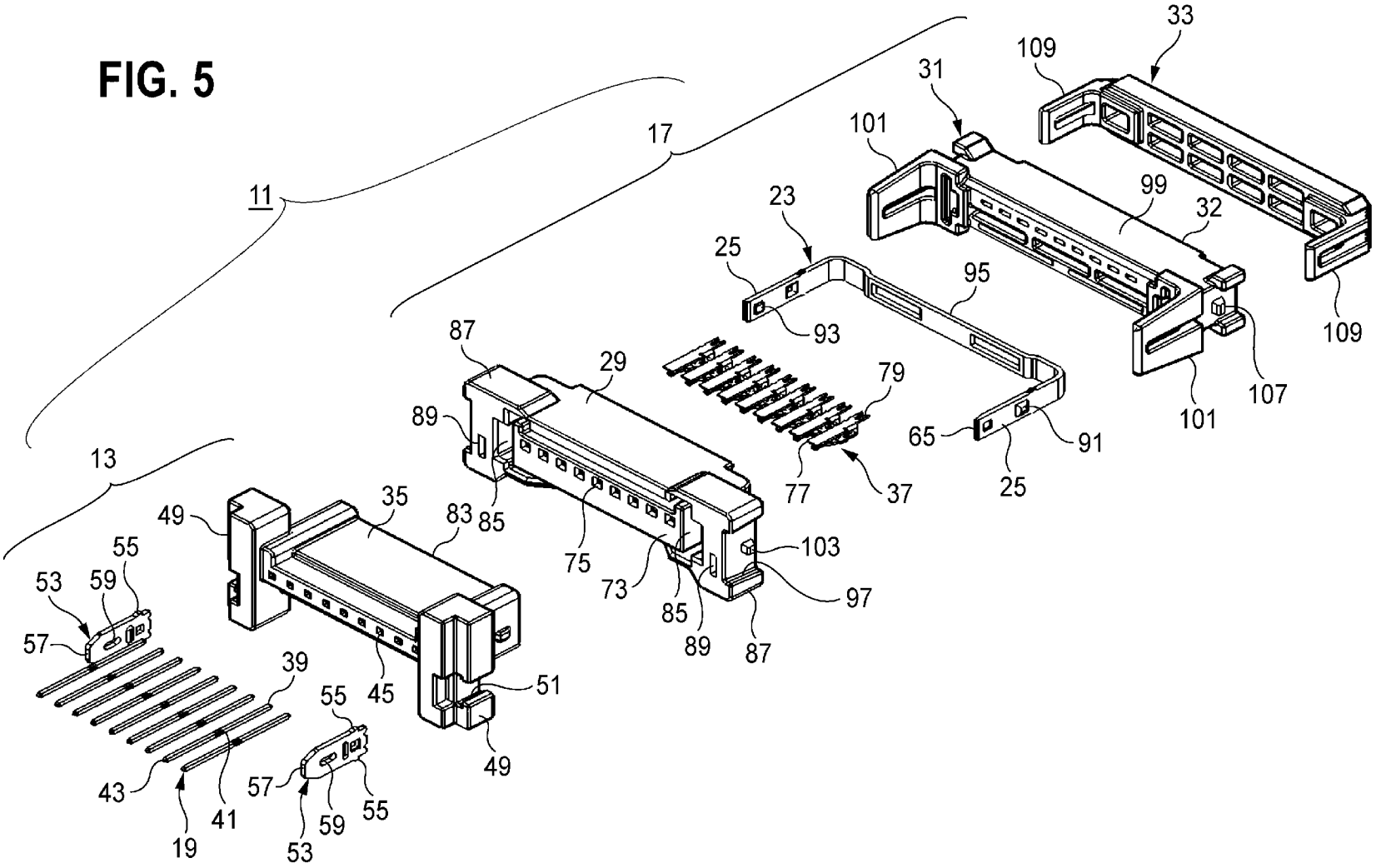
FIG. 5 is an exploded perspective view of the connector device shown in FIG. 2.

As shown in FIG. 5, the board side connector 13 has a board side housing 35 made of synthetic resin, to which the plurality of board side terminals 19 are press-fitted and mounted. In this embodiment, the board side terminals 19 are male terminals. Therefore, electric wire side terminals 37 which are mounted to the electric wire side connector 17 become female terminals.

From the front side to the back side, the board side terminal 19 has an electrical contact tab 39, a press-fitting portion 41 and a leading portion 43 which are adjacently formed into a straight shape. When the board side terminal 19 is inserted from the side of the electrical contact tab 39 into a board terminal insertion opening 45 which opens at the back side of the board side housing 35, the press-fitting portion 41 is inseparably mounted to the board side housing 35. The leading portion 43 of the mounted board side terminal 19 is derived from the back side of the board side housing 35, and the leading portion 43 is inserted into a through hole 47 (refer to FIG. 1) of the circuit board 21 and soldered.

Board abutting portions 49 which extend in a direction perpendicular to the direction in which the board side terminals 19 are paralleled are integrally formed at the back sides of the two sides of the board side housing 35. Peg mounting grooves 51 extending in the engaging direction are formed on the outside surfaces of the board abutting portions 49. Pegs 53 which are fixing metal fittings made of conductive metal and formed into a substantially rectangular shape are inserted into the peg mounting grooves 51.

The inserted pegs 53 are press-fitted and fixed into the peg mounting grooves 51 by making peg locking claws 55, which project from two side edges, locked. Through holes 59 are bored through peg projecting ends 57 of the pegs 53 to raise fixing strength at the time of soldering the pegs 53 with the circuit board 21. Further, the pegs 53 are provided with spacing projections 61 (refer to FIGS. 10A and 10B) to make the pegs 53 spaced from the outside surfaces of the board side housing 35, peg recesses 63 (refer to FIG. 9A) with which the U-shaped two ends projecting pieces 25 of the bus bar plate 23 are engaged, and peg ridges 67 (refer to FIG. 4) against which bar distal end edges 65 (refer to FIG. 2) of the U-shaped two ends projecting pieces 25 abut.

When the pegs 53 are fixed into the peg mounting grooves 51, while the peg projecting ends 57 at the sides of the through holes 59 project toward the circuit board 21 from the board abutting portions 49, the sides of the peg recesses 63 are placed in the peg mounting grooves 51. The peg projecting ends 57 which project from the board abutting portions 49 are inserted into peg fixing holes 69 (refer to FIG. 11), which are bored through the circuit board 21, and soldered. That is, the pegs 53 are fixed to the board side housing 35, and are electrically connected to a grounding circuit 71 (refer to FIG. 11) of the circuit board 21 while holding and fixing the board side housing 35 to the circuit board 21.

As shown in FIG. 5, the electric wire side terminals 37 of the electric wire side connector 17 are mounted into the electric wire side housing 29. The electric wire side terminals 37, which are mounted into the electric wire side housing 29, have electrical contact boxes 77 which contact the electrical contact tabs 39 of the board side connector 13 which enter from terminal receiving openings 75 which open at an electric wire side housing engaging distal end surface 73. The electrical contact boxes 77 of the electric wire side terminals 37 are locked to unshown lances, which are provided inside the electric wire side housing 29, to be inseparably mounted into the electric wire side housing 29. The electric wire side terminals 37 have press-contacting blades 79 that are provided adjacently behind the electrical contact boxes 77. The press-contacting blades 79 cut internal coatings of signal lines 81 (refer to FIG. 7B) of the shielded electric wire 15 to be electrically connected to the conductors.

Figure 6B:
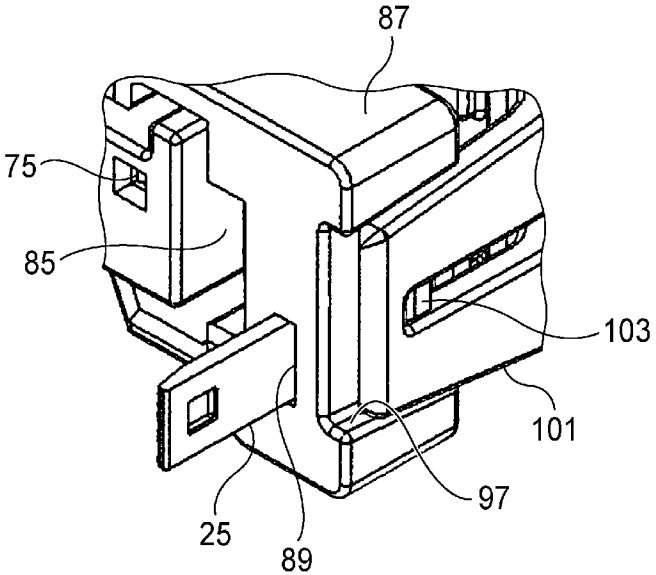
FIG. 6B is an enlarged view of a part (A) of FIG. 6A.
Figure 6A:
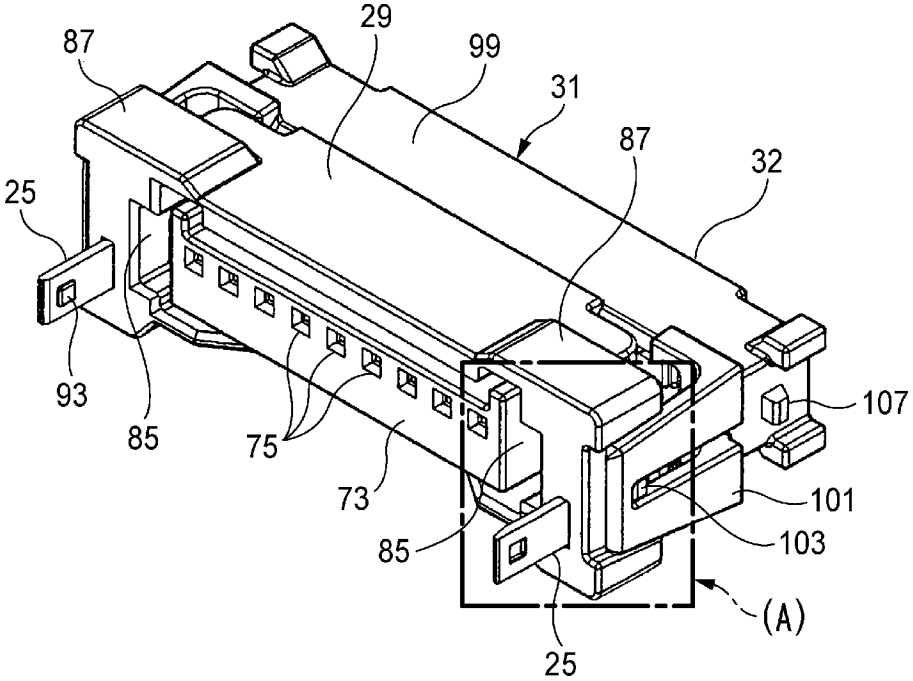
FIG. 6A is a perspective view of the electric wire side connector from which the electric wire sheath cover is separated.

Hood insertion grooves 85 into which a hood portion 83 (refer to FIG. 9B) of the board side housing 35 is inserted are formed around the electric wire side housing engaging distal end surface 73. Engaging block portions 87, which swell in a direction perpendicular to the direction in which the electric wire side terminals 37 are paralleled, are integrally formed at the front sides of the two sides of the electric wire side housing 29. The engaging block portions 87 abut against the board abutting portions 49 when the board side connector 13 is engaged with the electric wire side connector 17. Bus bar through holes 89 penetrating in the forward/backward direction are bored through the engaging block portions 87, respectively. The U-shaped two ends projecting pieces 25 of the bus bar plate 23 penetrate through the bus bar through holes 89, and the penetrating U-shaped two ends projecting pieces 25 project forward from the engaging block portions 87 as shown in FIGS. 6A and 6B.

Figure 8:
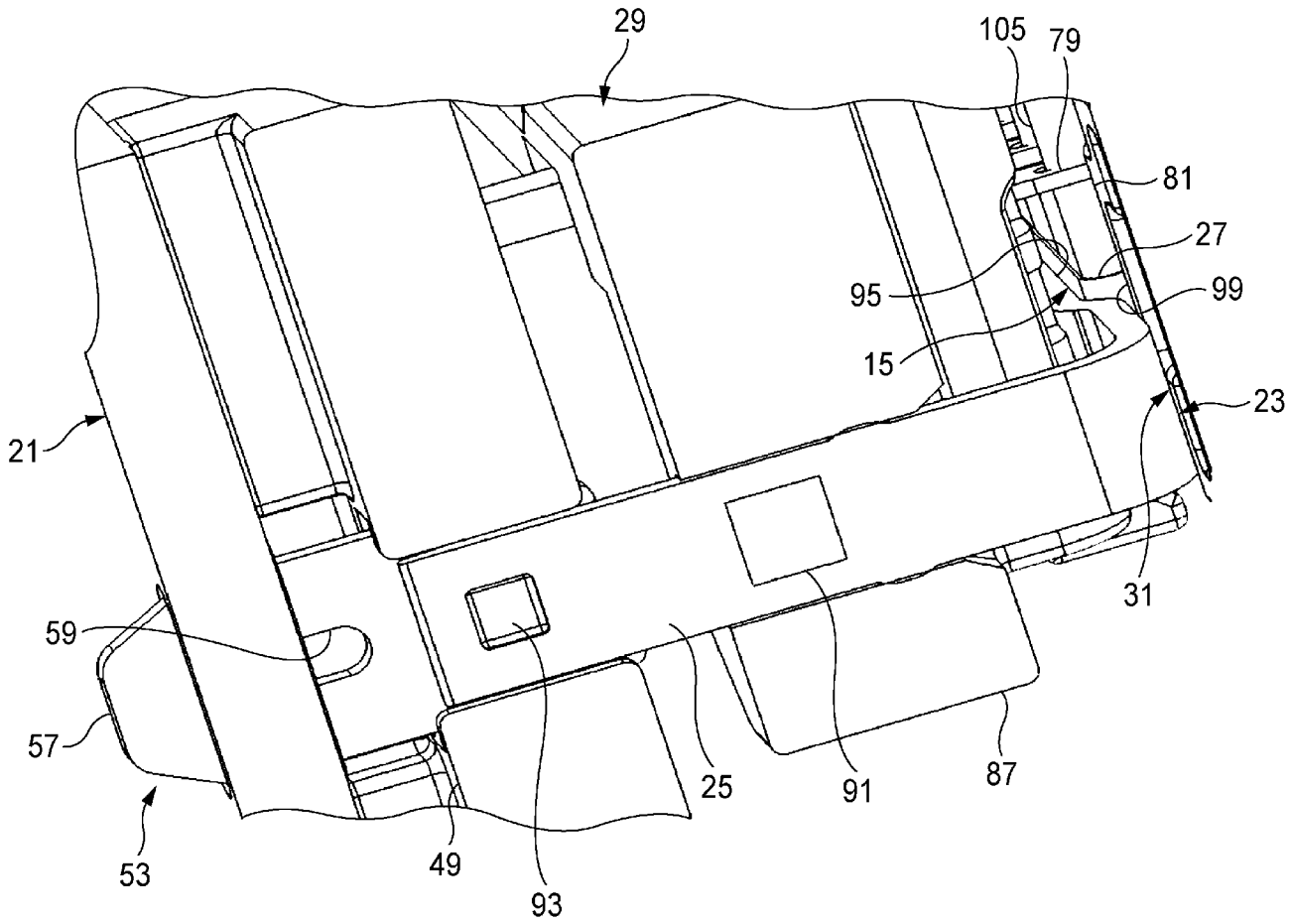
FIG. 8 is an enlarged view of main parts of the connector device shown in FIG. 7A.

The bus bar plate 23 is formed into a U-like shape by perpendicularly bending two sides of a belt-shaped metal plate by the same length to one surface side, and the bent two end sides become the U-shaped two ends projecting pieces 25. The U-shaped two ends projecting pieces 25 are formed with bus bar side locking projections 91 (refer to FIG. 5) which are engaged in the bus bar through holes 89, and bus bar salients 93 (refer to FIGS. 10A and 10B) which are engaged in the peg recesses 63, respectively. The part of the bus bar plate 23 between the U-shaped two ends projecting pieces 25 becomes a shielding board 95 (refer to FIG. 5). The shielding board 95 is arranged to cover and clamp the back side of a distal end 105 of the shielded electric wire 15 which is connected to the electric wire side terminals 37 which are mounted in the electric wire side housing 29, while the bus bar plate 23 is fixed to the electric wire side housing 29. As shown in FIG. 8, the press-contacting blades 79 of the electric wire side terminals 37 bypass the shielding board 95 and project backward without contacting the shielding board 95.

The strain relief 31 is mounted to the back side of the electric wire side housing 29 to which the bus bar plate 23 is mounted. Strain relief fixing grooves 97 (refer to FIG. 5) are concavely provided on the outside surfaces of the engaging block portions 87 of the electric wire side housing 29. The strain relief 31 has locking frames 101, which project toward the engaging block portions 87, at two sides of a cuboid electric wire wound portion 99 (refer to FIG. 5). The strain relief 31 is fixed to the electric wire side housing 29 when the locking frames 101 are locked to relief fixing projections 103 in the strain relief fixing grooves 97 while the electric wire wound portion 99 abuts against the shielding board 95 of the bus bar plate 23.

The shielding portion 27 of the shielded electric wire 15 is clamped between the shielding board 95 and the electric wire wound portion 99, as shown in FIG. 8. That is, the strain relief 31 clamps the shielding portion 27, which is exposed at the distal end 105 of the shielded electric wire 15, together with the bus bar plate 23 which is fixed to the electric wire side housing 29.

Cover locking projections 107 (refer to FIG. 5) are provided at two sides of the electric wire wound portion 99 behind the locking frames 101. The electric wire sheath cover 33 is mounted from the back side to the back end portion 32 of the strain relief 31, and is fixed to the strain relief 31 when cover locking frames 109 (refer to FIG. 5) at two sides of the electric wire sheath cover 33 are locked to the cover locking projections 107 of the electric wire wound portion 99. The part of the shielded electric wire 15 that is covered with a sheath portion 111 is clamped between the electric wire wound portion 99 and the electric wire sheath cover 33. That is, the electric wire sheath cover 33 clamps the sheath portion 111 (refer to FIG. 7B) of the shielded electric wire 15 together with the back end portion 32 of the strain relief 31 which clamps the shielding portion 27.

Figure 7B:
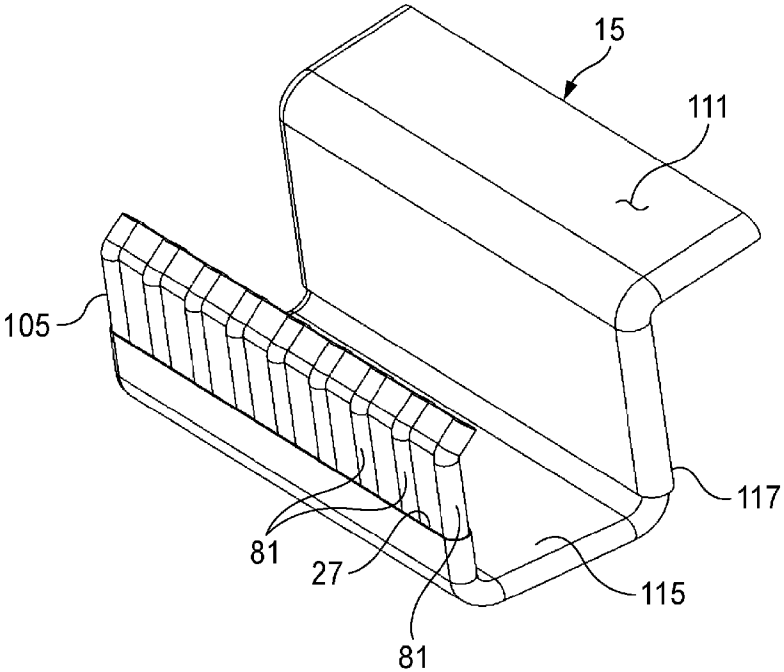
FIG. 7B is a perspective view of the shielded electric wire shown in FIG. 7A.
Figure 7A:
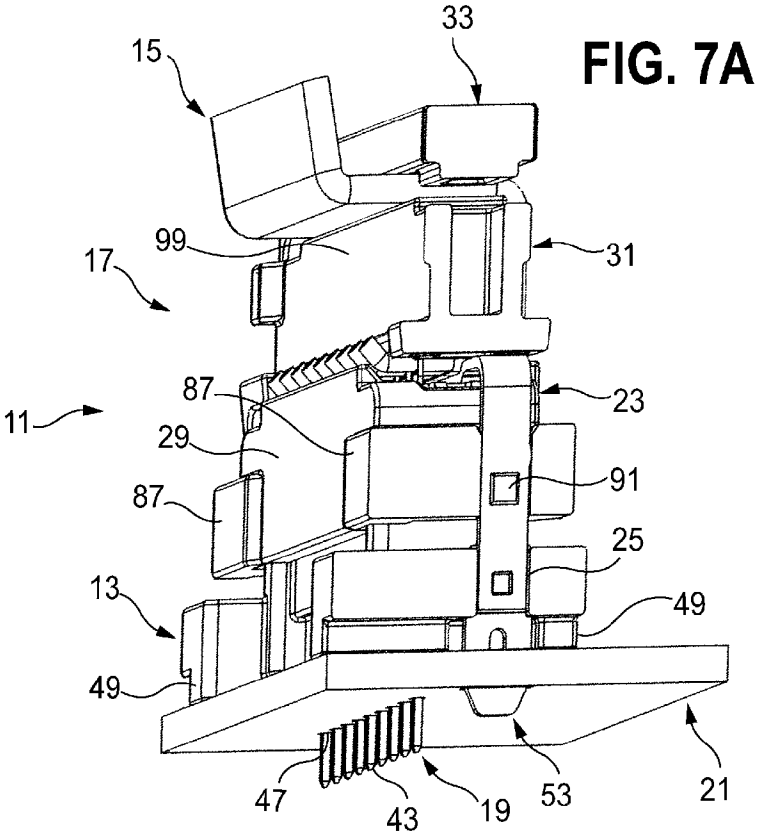
FIG. 7A is a perspective view of the connector device shown in FIG. 1 from the bottom side of the circuit board.

As shown in FIG. 7A, the strain relief 31 is so constructed that when the shielded electric wire 15 is clamped by being wound around the electric wire wound portion 99, a tensile force that acts on the shielded electric wire 15 is supported by friction, and the external force will not act on those conductor contacting portions where the conductors of the signal lines 81 and the electric wire side terminals 37 contact. The shielded electric wire 15 that is wound around the electric wire wound portion 99 is bent into a U-like shape, as shown in FIG. 7B. At the distal end 105 of the bent shielded electric wire 15, the sheath portion 111 is removed so that the shielding portion 27 made of silver foils or the like is exposed. The plurality of signal lines 81 whose conductors are further covered by internal coatings are derived from the shielding portion 27.

As shown in FIG. 8, the shielding portion 27 contacts the shielding board 95 of the bus bar plate 23 which is mounted to the electric wire side housing 29 from the back side, and is pushed and clamped by the strain relief 31 from the back side of the shielding portion 27. Thereby, the shielding portion 27 and the bus bar plate 23 are electrically connected. The plurality of signal lines 81 are derived from the shielding portion 27, and the internal coatings of the signal lines 81 are respectively cut by corresponding press-contacting blades 79 so that the conductors of the signal lines 81 are electrically connected to the corresponding electric wire side terminals 37.

Figure 9A:
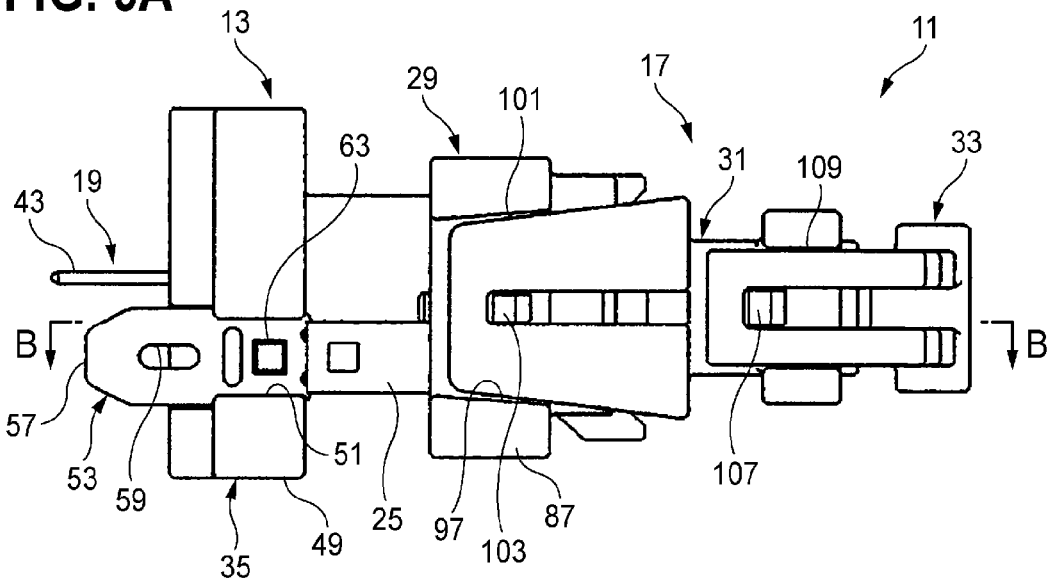
FIG. 9A is a side view during the engagement of the connector device shown in FIG. 2.
Figure 9B:
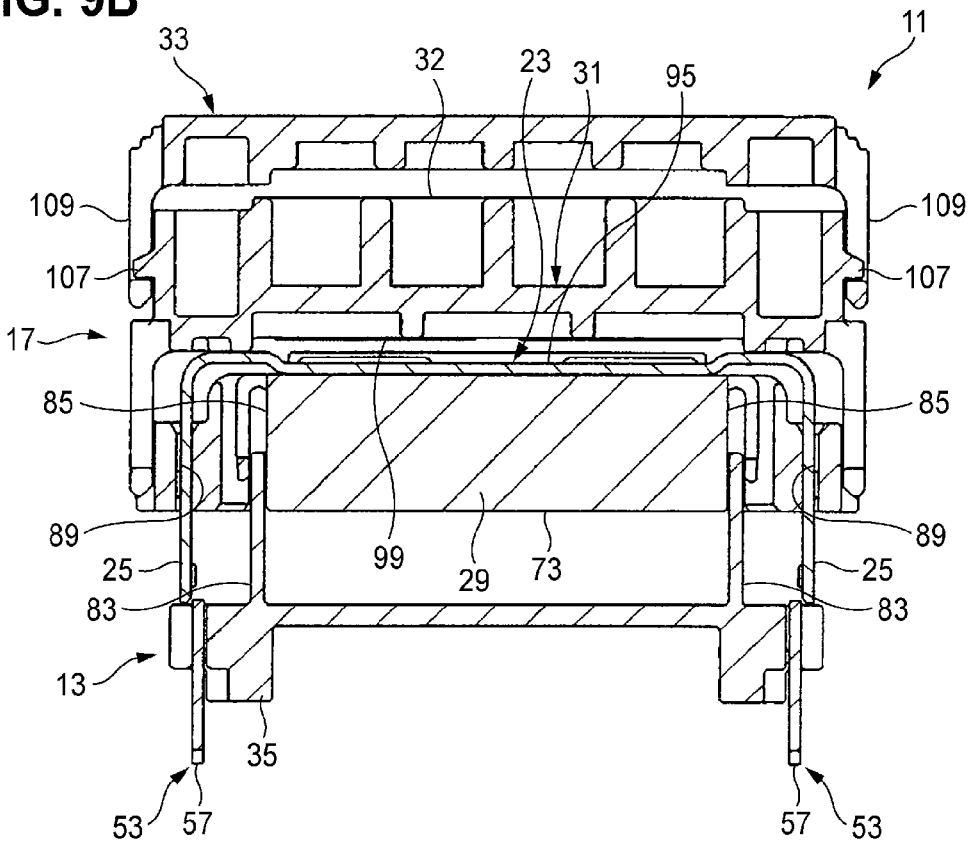
FIG. 9B is a B-B sectional view of FIG. 9A.

As shown in FIGS. 9A and 9B, just before the engagement of the electric wire side connector 17 and the board side connector 13, the hood portion 83 of the board side connector 13 is inserted into the hood insertion grooves 85 so that the connectors are relatively positioned. While the connectors are positioned, the U-shaped two ends projecting pieces 25 which project from the electric wire side connector 17 are arranged to approach the outsides of the pair of pegs 53 of the board side connector 13.

Figure 10A:
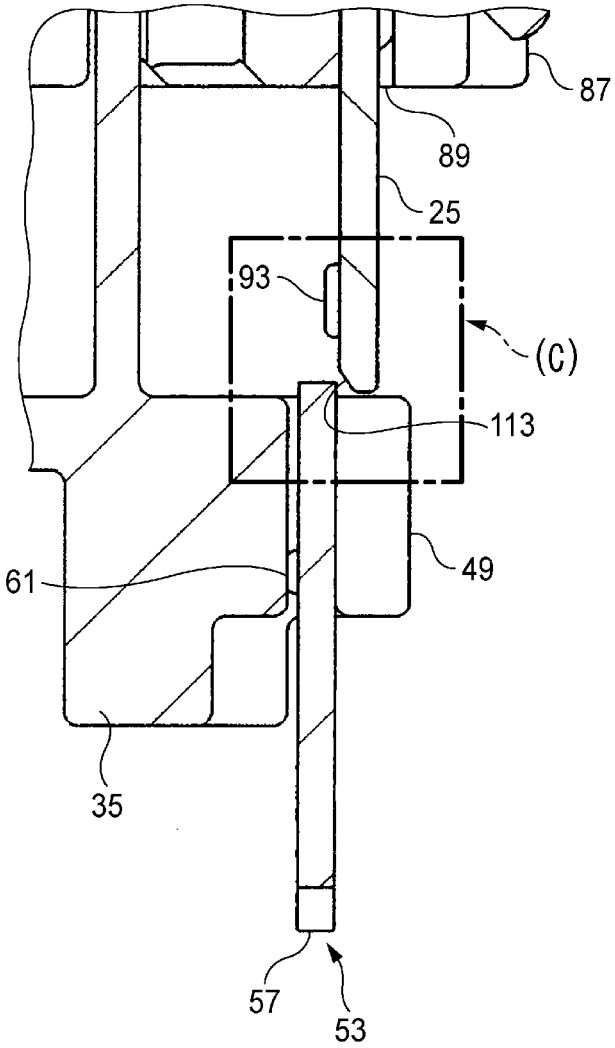
FIG. 10A is an enlarged view of main parts of the connector device shown in FIG. 9B.
Figure 10B:
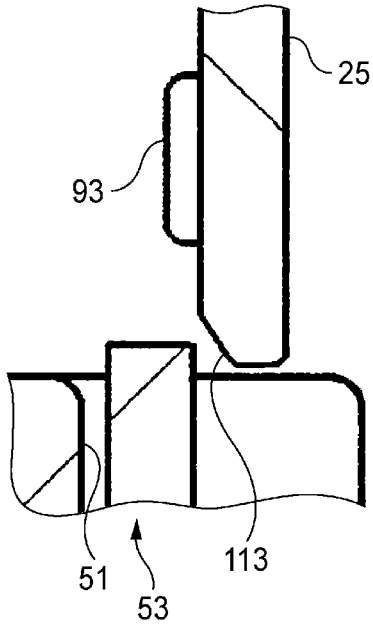
FIG. 10B is an enlarged view of a part (C) of FIG. 10A.

As shown in FIGS. 10A and 10B, pick-up allowances 113 which are form of inclined planes are provided at the distal end inner sides of the U-shaped two ends projecting pieces 25, respectively. Because the U-shaped two ends projecting pieces 25 are not regulated in the inward/outward direction (rightward/leftward direction in FIG. 10A), the U-shaped two ends projecting pieces 25 can move freely in the inward/ outward direction. Thereby, the U-shaped two ends projecting pieces 25 of the bus bar plate 23 are elastically deformable along the direction in which the U-shaped two ends projecting pieces 25 contact the pegs 53.

Figure 11:
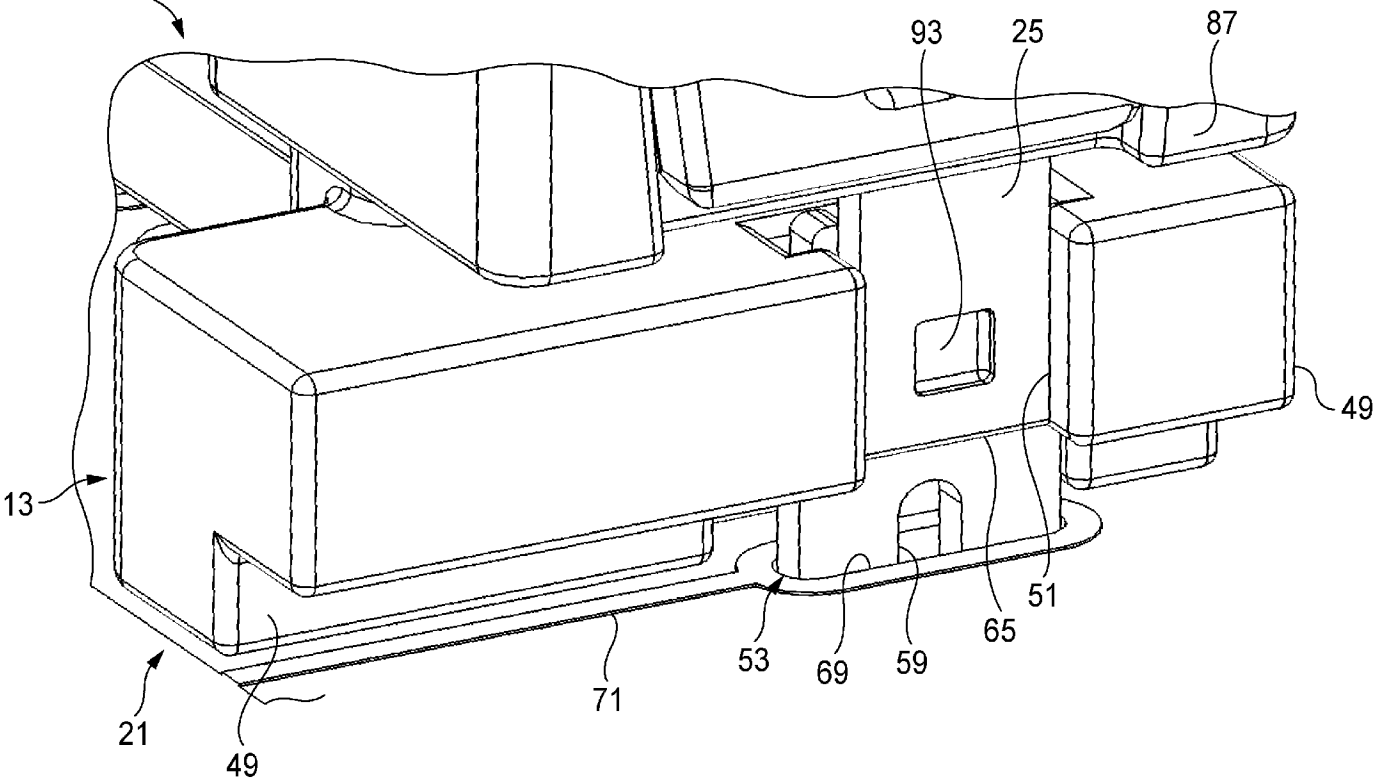
FIG. 11 is a main parts enlarged perspective view which indicates a bus bar plate of the electric wire side connector which contacts a fixing metal fitting of the board side connector while the connectors are engaged.
Figure 12:
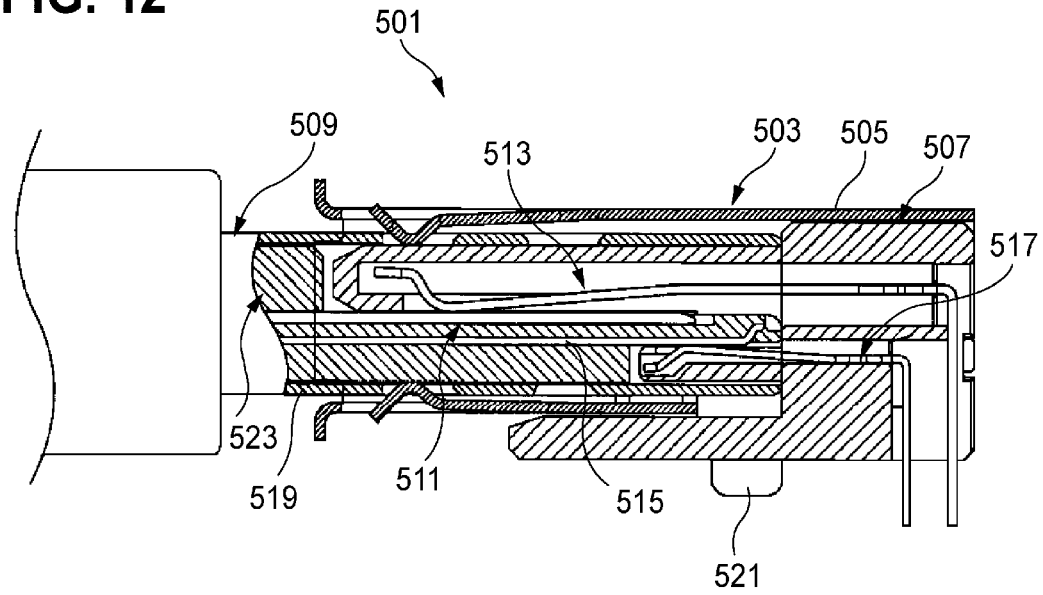
FIG. 12 is a sectional view of a traditional connector device.

Therefore, as the engagement proceeds from the state of FIGS. 10A and 10B, the U-shaped two ends projecting pieces 25 are elastically deformed and bent outward while the pick-up allowances 113 abut against the pegs 53, and slide on the outer surfaces of the pegs 53 until predetermined positions. The U-shaped two ends projecting pieces 25 which slide to the predetermined positions enter a definite contact state when the bus bar salients 93 engage into the peg recesses 63 (refer to FIG. 4) and the bar distal end edges 65 abut against the peg ridges 6 (refer to FIG. 4), as shown in FIG. 11.

Then, the operation of the connector device 11 having the above constitution is described.

For the connector device 11 according to the present embodiment, the shielding portion 27, which is exposed at the distal end 105 of the shielded electric wire 15, becomes electrically connected to the bus bar plate 23 by being clamped between the strain relief 31 and the bus bar plate 23 while contacting from the back side the bus bar plate 23 that is fixed to the electric wire side housing 29 in the electric wire side connector 17. The internal coatings of the signal lines 81 that are derived from the shielding portion 27 of the shielded electric wire 15 are cut by the press-contacting blades 79 of the electric wire side terminals 37 that are derived from the electric wire side housing 29 to the back side, and the conductors of the signal lines 81 are electrically connected to the electric wire side terminals 37.

The U-shaped two ends projecting pieces 25 of the bus bar plate 23 which is mounted to the electric wire side housing 29 project toward the front side of the engaging direction of the electric wire side housing 29.

Then, when the electric wire side connector 17 is engaged with the board side connector 13 which is held and fixed to the circuit board 21, the U-shaped two ends projecting pieces 25 of the bus bar plate 23 which is fixed to the electric wire side housing 29 electrically contact the pegs 53 which are fixed to the two sides of the board side housing 35 of the board side connector 13. Because the pegs 53 are electrically connected to the grounding circuit 71 of the circuit board 21, the shielding portion 27 of the shielded electric wire 15 and the grounding circuit 71 at the circuit board side can be electrically connected. Thus, the traditional metal shielding cases for sealing, which cover the electric wire side housing and the board side housing, respectively, can be omitted.

For the connector device 11 of the present embodiment, the shielded electric wire 15 is bent into a roughly U-like shape including the distal end 105 where the signal lines 81 and the shielding portion 27 are exposed, a bent bottom portion 115 at the back side of the distal end 105, and a reverse L-like portion 117 at the back side of the bent bottom portion 115 (refer to FIG. 7B). The distal end 105 of the shielded electric wire 15 which is bent into the roughly U-like shape is clamped by the electric wire side housing 29 and the strain relief 31, between which the bus bar plate 23 is interposed.

After the bent bottom portion 115 of the shielded electric wire 15 is bent into the U-like shape along the outer periphery of the strain relief 31, the shielded electric wire 15 is derived to the back side as the reverse L-like portion 117. Because the reverse L-like portion 117, which is a part covered with the sheath portion 111 at the back side of the distal end 105 to which the electric wire side terminals 37 are connected, is clamped by the strain relief 31 and the electric wire sheath cover 33, it is not feared that the tensile force that acts on the shielded electric wire 15 would act on the conductor contact portion where the conductors of the shielded electric wire 15 and the electric wire side terminals 37 contact. Thus, it is possible to improve the connection reliability of the electric wire side connector 17 which is connected to the distal end 105 of the shielded electric wire 15, and the electric wire side connector 17 can be definitely fixed at a high pulling strength to the end of the shielded electric wire 15.

Furthermore, for the connector device 11 of the present embodiment, the interval between the U-shaped two ends projecting pieces 25 of the bus bar plate 23 which project in the engaging direction from the two sides of the electric wire side housing 29 is set smaller than the interval between the pair of pegs 53 which are provided at the two sides of the board side housing 35. On the other hand, the distal ends of the U-shaped two ends projecting pieces 25 are provided with the pick-up allowances 113 to make the U-shaped two ends projecting pieces 25 bend outward beyond the pegs 53 at the time of contacting the pegs 53. Therefore, when the electric wire side housing 29 is engaged with the board side housing 35, the pick-up allowances 113 which abut against the pegs 53 make the U-shaped two ends projecting pieces 25 elastically deform to the outsides of the pegs 53.

When the connectors have been engaged with each other, the U-shaped two ends projecting pieces 25 which are elastically deformed are pressed to the pegs 53 from outside by elastic restoring forces. Thereby, when the connectors are engaged with each other, while the bus bar plate 23 is prevented from escaping from the pegs 53, and a high contacting reliability is obtained.

Therefore, for the connector device 11 according to the present invention, the size can be reduced, and the cost can be reduced because the metal members for shielding are reduced.

The features of the embodiment of the connector device according to the present invention described above are briefly, collectively listed in the following [1] to [3], respectively.

[1] A connector device including:

an electric wire side connector 17 to which a shielded electric wire 15 is connected; and a board side connector 13 that is connected to a circuit board 21, wherein the electric wire side connector 17 is engaged with the board side connector 13, the electric wire side connector 17 includes:

an electric wire side housing 29 which receives and holds electric wire side terminals 37 which are electrically connected to conductors of the shielded electric wire 15, and an electric wire clamping member (strain relief) 31 which clamps a shielding portion 27 which is exposed at a distal end 105 of the shielded electric wire 15 between the electric wire clamping member 31 and a bus bar plate 23 which is fixed to the electric wire side housing 29, the board side connector 13 includes:

a board side housing 29 which receives and holds board side terminals 19 which are electrically connected to the electric wire side terminals 37, respectively, and a fixing metal fitting (peg) 53 which is fixed to the board side housing 35 and is electrically connected to a grounding circuit 71 of the circuit board 21 while holding and fixing the board side housing 35 to the circuit board 21, and the bus bar plate 23 electrically contacts the fixing metal fitting (peg) 53 when the board side connector 13 is engaged with the electric wire side connector 17.

[2] The connector device 11 according to the above [1], wherein the electric wire side connector 17 has an electric wire sheath cover 33 which clamps a part of the shielded electric wire 15 that is covered with a sheath portion 11 with a back end portion 32 of the electric wire clamping member (strain relief) 31 which clamps the shielding portion 27.

[3] The connector device 11 according to the above [1] or [2], wherein the bus bar plate 23 is elastically deformable along a contact direction in which the bus bar plate 23 contact the fixing metal fitting (peg) 53.

The present invention is not limited to the above-described embodiments, and suitable modifications, improvements and the like can be made. Moreover, the materials, shapes, dimensions, numbers, installation places, and the like of the components in the above embodiment are arbitrarily set as far as the invention can be attained, and not particularly restricted.

For the connector device according to the present invention, the size can be reduced, and the cost can be reduced because the metal members for shielding are reduced.

What is claimed is:

1. A connector device comprising:

an electric wire side connector to which a shielded electric wire is connected; and a board side connector that is connected to a circuit board, wherein the electric wire side connector is engaged with the board side connector, the electric wire side connector includes:

an electric wire side housing which receives and holds electric wire side terminals which are electrically connected to conductors of the shielded electric wire, and an electric wire clamping member which clamps a shielding portion which is exposed at a distal end of the shielded electric wire between the electric wire clamping member and a separate elongated bus bar plate, the separate elongated bus bar plate being fixed between the electric wire side housing and the electric wire clamping member, the board side connector includes:

a board side housing which receives and holds board side terminals which are electrically connected to the electric wire side terminals, respectively, and a fixing metal fitting which is fixed to the board side housing and is electrically connected to a grounding circuit of the circuit board while holding and fixing the board side housing to the circuit board, and the bus bar plate electrically contacts the fixing metal fitting when the board side connector is engaged with the electric wire side connector.

2. The connector device according to claim 1, wherein the electric wire side connector has an electric wire sheath cover which clamps a part of the shielded electric wire that is covered with a sheath portion with a back end portion of the electric wire clamping member which clamps the shielding portion.

3. The connector device according to claim 1, wherein the bus bar plate is elastically deformable along a contact direction in which the bus bar plate contact the fixing metal fitting.

4. The connector device according to claim 2, wherein the bus bar plate is elastically deformable along a contact direction in which the bus bar plate contact the fixing metal fitting.

* * * * *